United States Patent [19]

Watermann

[11] Patent Number: 4,586,851

[45] Date of Patent: May 6, 1986

[54] LEVELLING RAM FOR ROOF-SHIELD MINE SUPPORT SYSTEMS

[75] Inventor: Willy Watermann, Dortmund, Fed. Rep. of Germany

[73] Assignee: Kloeckner-Becorit GmbH, Castrop-Rauxel, Fed. Rep. of Germany

[21] Appl. No.: 625,092

[22] Filed: Jun. 27, 1984

[30] Foreign Application Priority Data

Jun. 28, 1983 [DE] Fed. Rep. of Germany ... 8318615[U]

[51] Int. Cl.[4] ..... E21D 17/02; E21D 23/00; E21D 23/16

[52] U.S. Cl. ..... 405/295; 405/291; 405/302

[58] Field of Search ..... 405/291, 292, 294, 295, 405/297–302; 248/357; 91/170 MP

[56] References Cited

U.S. PATENT DOCUMENTS

| | | | |
|---|---|---|---|
| 3,218,812 | 11/1965 | Wilkenlon | 405/297 |
| 3,631,681 | 1/1972 | Woodthorpe et al. | 405/302 X |
| 3,837,170 | 9/1974 | Martinko et al. | 405/295 |
| 3,857,246 | 12/1974 | Roenspies et al. | 405/302 |
| 4,306,822 | 12/1981 | Weirich et al. | 405/294 |

FOREIGN PATENT DOCUMENTS

| | | | |
|---|---|---|---|
| 1049471 | 11/1966 | United Kingdom | 405/301 |
| 1054651 | 1/1967 | United Kingdom . | |
| 1134552 | 11/1968 | United Kingdom . | |

*Primary Examiner*—D. Taylor
*Assistant Examiner*—Nancy J. Stodola
*Attorney, Agent, or Firm*—Watson, Cole, Grindle & Watson

[57] ABSTRACT

In a roof-shield support system employed in mines, at least two levelling rams each acting between a shield frame unit and an associated gap-seal plate, the latter being arranged so as to be slidable relative to the associated shield frame unit. Each levelling ram comprises a cylinder, piston and piston rod, is arranged so that the piston rod has a longitudinal bore which is open at the piston end of the piston rod, and an elongated rod which is sealed relative to the piston rod being disposed within said bore. The bore is in use in communication with a hydraulic fluid system of the ram and after levelling has occurred by actuation of the ram the pressurized hydraulic fluid admitted into the bore applies a force to the associated gap-seal plate so as to ensure its continuing tight engagement with the adjacent shield frame unit.

4 Claims, 5 Drawing Figures

LEVELLING RAM FOR ROOF-SHIELD MINE SUPPORT SYSTEMS

BACKGROUND OF THE INVENTION

The invention relates to a levelling ram for roof-shield mine support systems in which at least two such levelling rams are provided in each case between a shield frame unit and an associated gap-seal plate which is arranged slidably relative to the associated shield frame in a transverse direction relative to the direction of forepoling.

The levelling ram for roof-shield mine support systems, to which the present invention is directed, is generally disclosed in British Pat. Nos. 1,054,651 and 1,134,552, and in German Pat. No. 22 10 757, respectively as aligning cylinders 27, 28 and 10, 11, and 19. The frame units and gap seal plates, with which the levelling rams are associated as described herein, are likewise generally disclosed in these patents.

SUMMARY OF THE INVENTION

It is the object of the present invention to provide a levelling ram of the kind specified which enables the frame units to be lined up relative to each other and at the same time also enables the gap-seal plates to be maintained tightly applied to the respective adjacent shield frame unit.

According to the invention this objective is achieved in that the piston rod in the ram has a longitudinal bore which is open on the piston end and is in communication with an hydraulic fluid system, and in which an elongated rod is arranged which is sealed relative to the piston rod. With this arrangement it is possible, when hydraulic fluid is admitted into the longitudinal bore, to apply a force to the gap-seal plates in such a way as to assure their tight application to the adjacent shield frame unit.

According to a further feature of the invention the longitudinal bore extends to shortly before that end of the piston rod remote from the piston end. This has the advantage that the ram can execute a comparatively long stroke. Conveniently the elongated rod extends substantially over the length of the longitudinal bore and is provided with a continuous, through-extending longitudinal passage channel for the hydraulic fluid.

In such an arrangement it is preferred to construct the elongated rod in the form of a small hollow tube secured in fluid-tight manner in the bottom of the ram cylinder and terminating in a transverse bore for the hydraulic fluid which is also provided in the cylinder bottom. With this arrangement the hydraulic fluid can be conducted through the transverse bore and through the longitudinal passage channel in the elongated rod right up to the extreme end of the longitudinal bore in the piston rod.

Alternatively the constructional arrangement may be such that the elongated rod is arranged loose in the longitudinal bore and the latter terminates in a feed bore for hydraulic fluid. With such an arrangement the hydraulic fluid is delivered directly into the extreme outer end of the longitudinal bore without having to pass through a hollow rod.

Other objects, advantages and novel features of the invention will become more apparent from the following detailed description of the invention when taken in conjunction with the accompanying drawings.

Figure 1:
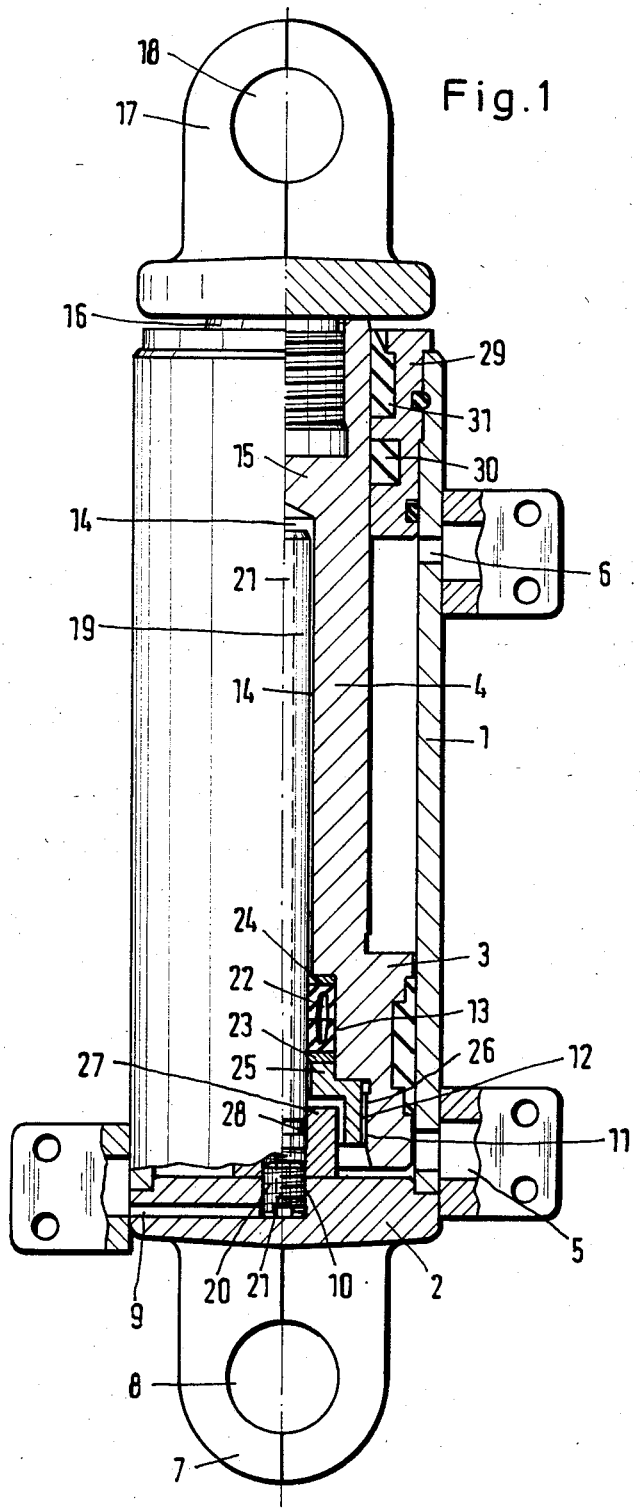
FIG. 1 is a part-sectional elevational view of a first embodiment of the invention.

Referring firstly to FIG. 1, the bottom end of a ram cylinder 1 shown therein has welded thereto a cylinder bottom casting 2 which is provided with a fork 7 and a bearing lug 8. In the cylinder bottom casting 2 there is arranged a transverse bore 9 which terminates in a longitudinal bore 10.

The cylinder is provided with a piston 3 which has a bore 11 which comprises an interior thread 12, and an adjoining further bore 13 of smaller radius. From the upper end of bore 13 starts a longitudinal bore 14 in the piston rod 4 which extends to a location shortly before upper end 15 of piston rod 4. Free end 16 of piston rod 4 is provided with a fork bracket 17 having a bearing lug 18.

A small elongated rod or tube 19 is secured at its lower end 20 in the longitudinal bore 10 of the cylinder bottom 2. The outer diameter of this tube 19 is slightly smaller than the bore 14 in the piston rod 4. The transverse bore 9 in the cylinder bottom casting 2 is in hydraulic flow-communication, via suitable cutouts in the lower end of tube 19, with the longitudinal bore 14 in piston rod 4 through the bore 21 of tube 19.

A rod-seal packing 22 is provided between two supporting rings 23 and 24 between tube 19 and bore 13 of piston 3. This packing 22 and its supporting rings 23, 24 are maintained in position by a nut 25 which has an exterior thread 26 whereby it is screwed to the interior thread 12 of piston 3.

The cylinder bottom casting 2 is welded to a ring 27 relative to which the tube 19 is sealed by a further packing 28. At the upper end 15 of piston rod 4 there is provided a guide sleeve 29 which carries a piston-rod packing seal 30 and a seal 31.

Figure 4:
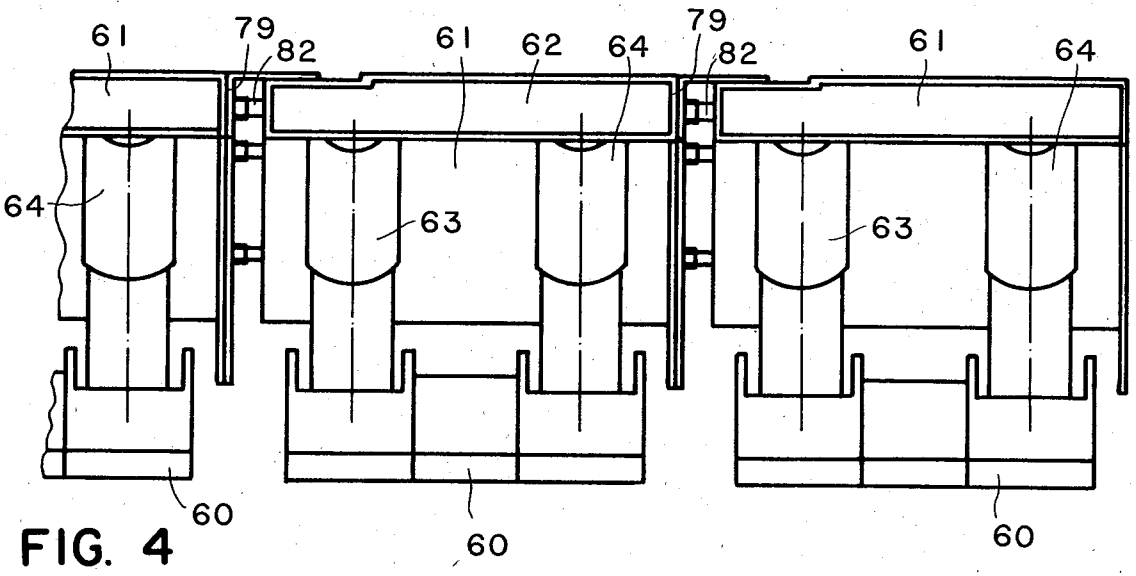
FIG. 4 is a front elevational view of adjacent shield frame units of FIG. 3.

When hydraulic fluid is applied through an orifice 5, the piston rod 4 is displaced in the upward direction which allows directional alignment of the associated shield-frame unit relative to the two adjacent units as shown in FIG. 4. When the frame units have been correctly lined up the pressure applied through orifice 5 is relieved.

The operative hydraulic pressure is constantly available in transverse bore 9 and extends through the longitudinal passage 21 in tube 19 into the longitudinal bore 14 of piston rod 4. This pressure is enough to apply the associated gap-seal plate tightly to the adjacent frame unit of the shield-support system. By an application of hydraulic pressure to the annular face of piston 3 via an orifice 6 (as an alterative to pressure applied through orifice 5) it is possible to retract the piston rod 4 in opposition to the pressure retract the piston rod 4 in opposition to the pressure in longitudinal bore 14.

Figure 3:
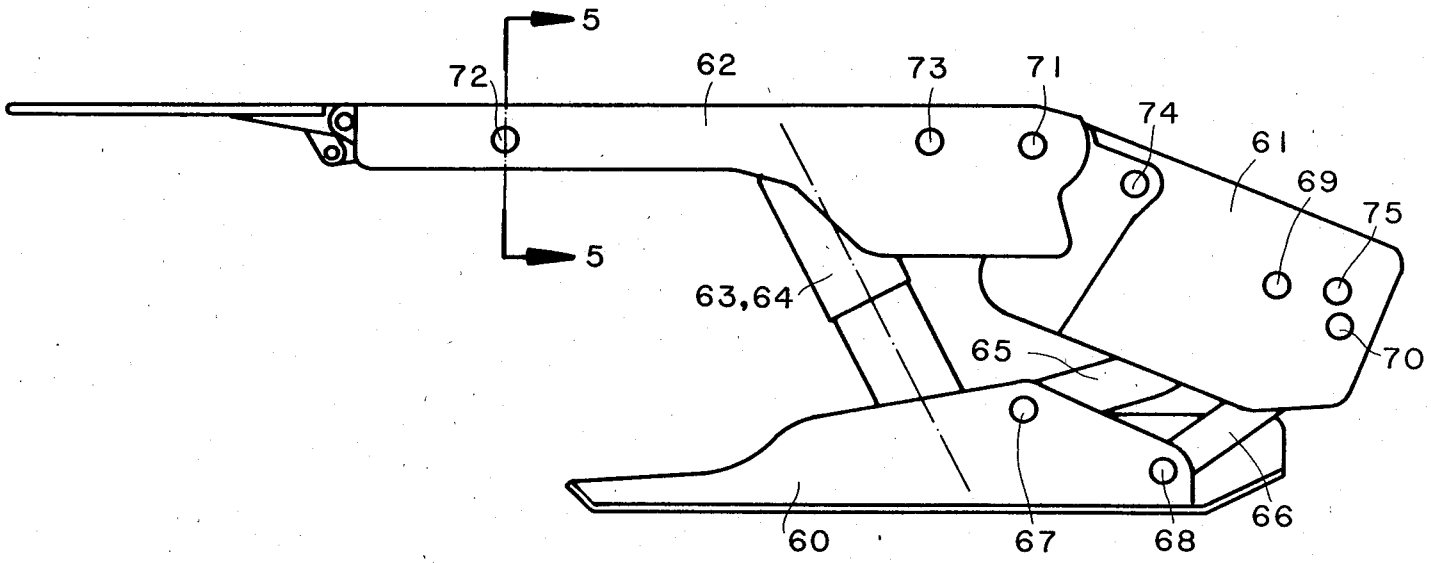
FIG. 3 is a side view of a shield frame unit.

As shown in FIGS. 3 and 4, each of the adjacent shield frame units comprises a base 60, a breakage shield 61, a hanging wall cap 62 and a pair of struts 63 and 64 which are pivotally mounted at opposite ends between base 60 and cap 62. Likewise, a pair of guide rods 65 and 66 extend between base 60 and shield 61, and are pivotally connected thereto as at 67, 69 and 68, 70, respectively. Hanging wall cap 62 is pivotally connected as at 71 to breakage shield 61. Extension rods 82 (FIGS. 4 and 5) are mounted at bearings 72, 73, 74 and 75 and extend laterally between adjacent frame units.

Figure 5:
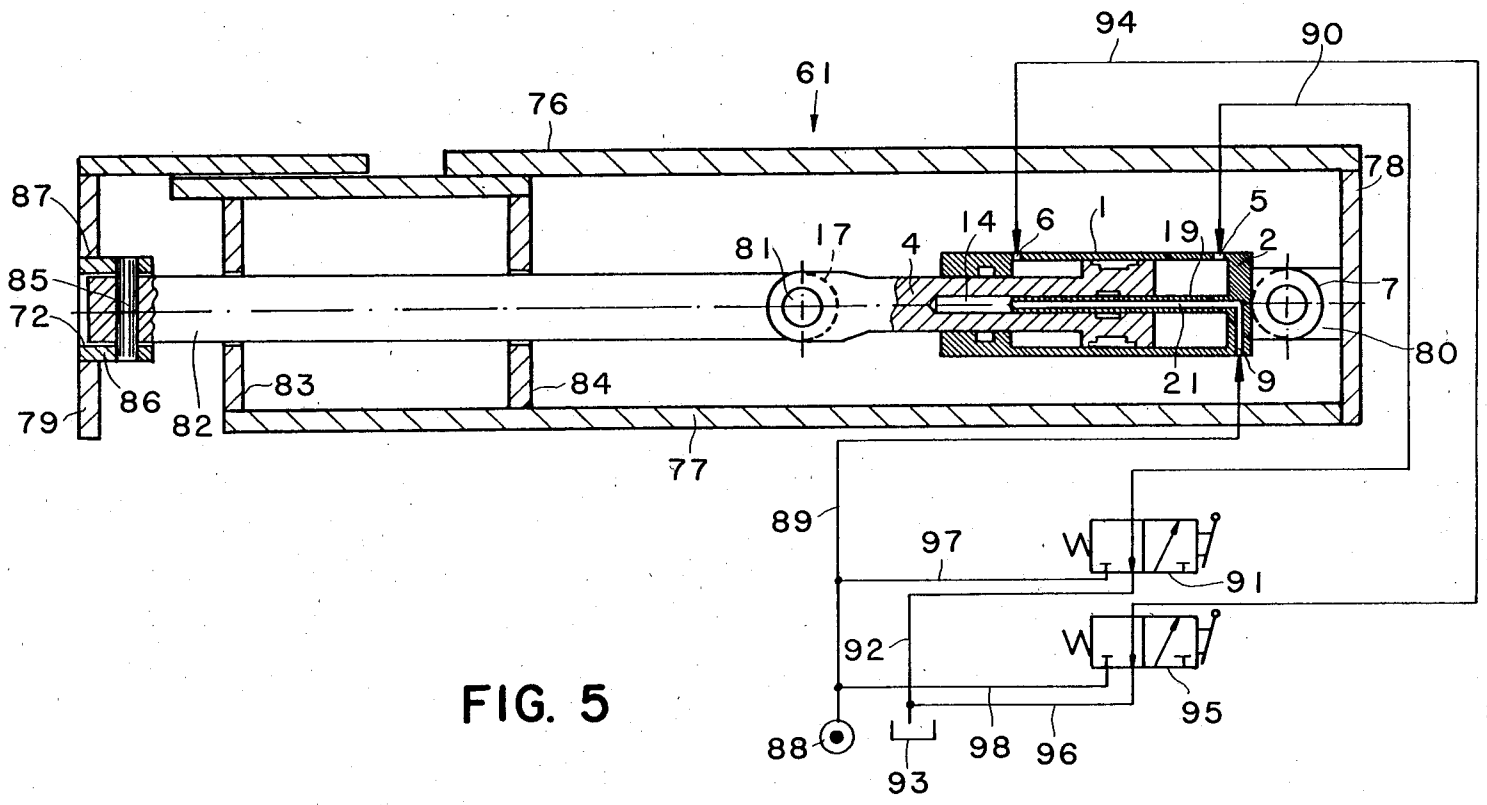
FIG. 5 is a sectional view taken substantially along the line 5—5 of FIG. 3, with a hydraulic schematic.

FIG. 5 illustrates a breaking shield 61 in section as comprising upper and lower plates 76 and 77 interconnected by a plate 78 at one end and having a movable gap-seal plate 79 at the opposite end. Directional cylinder 1 is mounted on a block 80 affixed to plate 78 via its fork 7 in a hinged manner. Various other details of the piston and cylinder unit of FIG. 1 are illustrated.

Extension rod 82 is pivotally mounted as 81 to bracket 17 of the piston rod, rod 82 extending through the openings of a pair of spaced fixed lateral plates 83 and 84. A bolt or pin 85 hingedly secures plates 86 and 87 to the free end of rod 82. Gap-seal plate 79 is secured to plates 86, 87.

Referring to the hydraulic circuit of FIG. 5, a source 88 of hydraulic fluid under high pressure is fed to transverse bore 9 through a high pressure line 89, so that gap-seal plate 79 is constantly subject to a force applied against the adjoining shield support frame. Orifice 5 is connected through a pipe 90 and a valve 91 and a pipe 92 to return supply 93. Similarly, inlet orifice 60 is connected through pipe 94 and a valve 95 and to return 93 via pipe 96.

By switching valve 91, high pressure line 97 can be set to inlet orifice 5, so that a corresponding force can be exerted through piston rod 4 and rod 82 on to gap-seal plate 79.

By switching valve 95 pressure is fed into orifice 6 through high pressure line 98 and line 94, which has the effect to retract piston rod 4 into cylinder 1.

Figure 2:
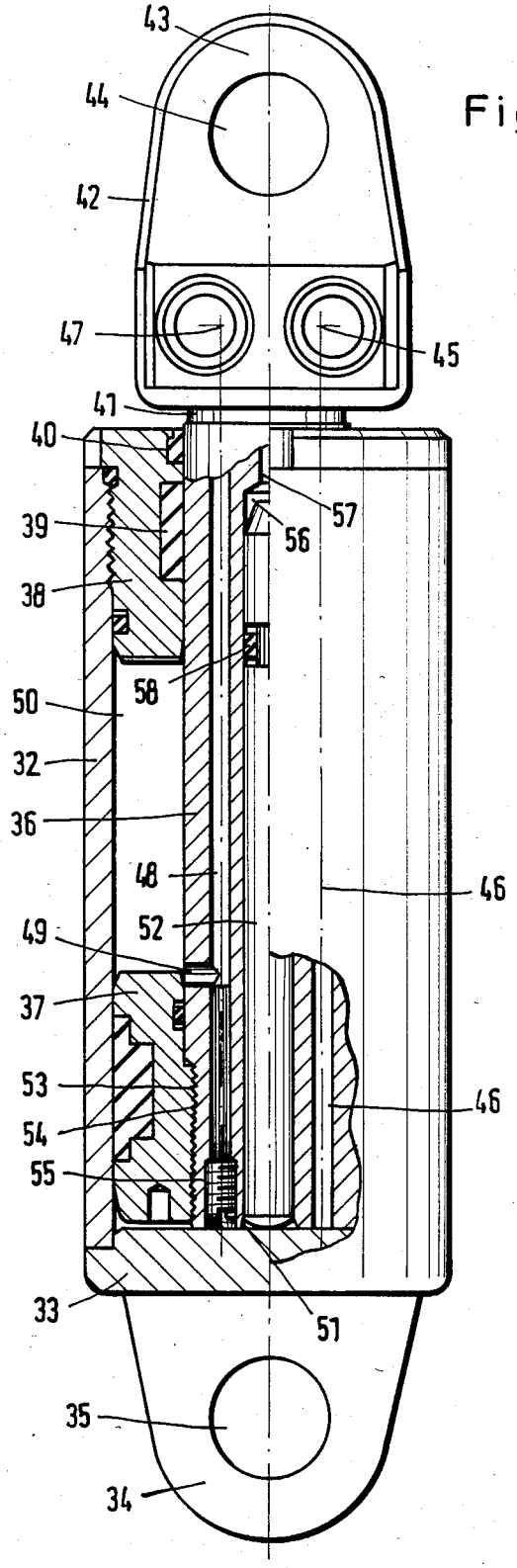
FIG. 2 is a part-sectional elevational view of another embodiment of the invention.

In the embodiment of the invention shown in FIG. 2, the ram-cylinder tube 32 is secured to a cylinder bottom casting 33 which carries a fork bracket 34 with a bearing lug 35. The piston rod 36 carries a piston 37 at one end thereof and its opposite end is guided in a guide sleeve 38 which is secured to the upper end of the cylinder tube 32. The piston rod 36 is sealed by means of packings 39 and 40. A headpiece 42 with fork bracket 43 and bearing lug 44 is arranged at the outer end 41 of piston rod 36. In the headpiece 42 there is further arranged a feed orifice 45 for hydraulic medium which reaches via passage 46 to the end of the piston rod. There is also provided a further hydraulic connection orifice 47 which leads through a passage channel 48 and a branch channel 49 into the annular space 50 inside the cylinder tube 32.

The piston rod 36 is provided with an internal bore 51 which is open at that end adjacent the piston and in which an elongated rod 52 is loosely, i.e., slidably, fitted. The piston 37 has an interior thread 53 whereby it is screwed onto the exterior thread 54 at the end of piston rod 36. The longitudinal bore 48 is closed by means of a plug 55 in the region of the piston.

The upper end 56 of longitudinal bore 51 leads into a feed bore 57 for hydraulic fluid which is of smaller diameter and communicates with supply 88.

On admission of hydraulic fluid to connection orifice 45 the hydraulic fluid flows through longitudinal channel 46 beneath piston 37 with the result that the piston rod 36 is pushed out. This enables the associated frame unit being directionally lined up as required. On application of pressure through orifice 47 the pressure medium flows into annular space 50 with the result that the piston rod is retracted.

The interiors of the hydraulic feed bores 57 and 56 are however constantly subject to the operative fluid pressure whereby the associated gap-seal plate can be applied tightly to the adjacent shield-frame unit but when the pressure medium is applied to the annular face of piston 37 the piston rod 36 is retracted against the effect of the pressure in longitudinal bore 56. The elongated rod 52 is sealed relative to the longitudinal bore 51 by means of the packing 58.

Obviously, many other modifications and variations of the present invention are made possible in the light of the above teachings. It is therefore to be understood that within the scope of the appended claims the invention may be practiced otherwise than as specifically described.

What is claimed is:

1. A roof-shield mine support system, comprising at least a pair of hydraulically operated levelling rams extendable between a shield frame unit and an associated gap-seal plate which is arranged slidably relative to the associated shield frame in a transverse direction relative to the direction of forepoling, each said ram comprising a piston and cylinder unit, opposite sides of said piston being connected to the hydraulic system of said piston and cylinder unit for extending and retracting said piston for aligning the associated shield frame unit relative to an adjacent shield frame unit, the piston rod of said piston having a longitudinal bore open at an outer end of said piston and closed at an end of said piston rod remote from said piston, and an elongated rod disposed within said bore, said rod being sealed relative to the interior of said bore, and the interior of said bore being connected in use to said hydraulic system for applying constant pressure between said piston and said cylinder for pressing the associated gap-seal plate tightly against the adjacent frame unit.

2. The ram according to claim 1, wherein said rod extends substantially through the length of said bore and has a continuously extending longitudinal passage for hydraulic fluid of the hydraulic system.

3. The ram according to claim 2, wherein said cylinder has a bottom wall, said rod comprising a hollow tube secured in fluid-tight manner to said bottom wall of said cylinder and terminating in a transverse bore for the hydraulic fluid which is located in said bottom wall of said cylinder.

4. The ram according to claim 1, wherein said rod is loosely disposed in said bore, and said bore being in communication with a feed bore of the hydraulic system.

* * * * *